US008797221B2

(12) United States Patent
Cetiner et al.

(10) Patent No.: US 8,797,221 B2
(45) Date of Patent: Aug. 5, 2014

(54) RECONFIGURABLE ANTENNAS UTILIZING LIQUID METAL ELEMENTS

(71) Applicant: Utah State University, North Logan, UT (US)

(72) Inventors: Bedri A. Cetiner, Logan, UT (US); Yasin Damgaci, Ithaca, NY (US); Luis Jofre, Barcelona (ES); Daniel Rodrigo, Barcelona (ES)

(73) Assignee: Utah State University, Logan, UT (US)

( * ) Notice: Subject to any disclaimer, the term of this patent is extended or adjusted under 35 U.S.C. 154(b) by 126 days.

(21) Appl. No.: 13/708,747

(22) Filed: Dec. 7, 2012

(65) Prior Publication Data

US 2014/0168022 A1 Jun. 19, 2014

Related U.S. Application Data

(60) Provisional application No. 61/568,041, filed on Dec. 7, 2011.

(51) Int. Cl.
*H01Q 3/12* (2006.01)
*H01Q 3/20* (2006.01)

(52) U.S. Cl.
CPC ..... *H01Q 3/20* (2013.01)
USPC ..... 343/761; 343/763; 343/818

(58) Field of Classification Search
USPC ..... 343/761, 764, 766, 817, 818, 819
See application file for complete search history.

(56) References Cited

U.S. PATENT DOCUMENTS 6,181,970 B1 1/2001 Kasevich
6,483,480 B1 11/2002 Sievenpiper et al.
6,501,427 B1 12/2002 Lilly et al.
6,859,189 B1 2/2005 Ramirez et al.
6,967,628 B2 11/2005 Rawnick et al.
7,084,828 B2 8/2006 Rawnick et al.
8,125,393 B2 2/2012 Dreina et al.

(Continued)

FOREIGN PATENT DOCUMENTS

JP 06350334 A 12/1994
JP 11097926 A 4/1999
KR 20080053081 A 6/2008
WO 2010029306 A1 3/2010

OTHER PUBLICATIONS

Cetiner et al., Compact and Broadband Antenna for LTE and Public Safety Applications, IEEE Antennas and Wireless Propagation Letters, Oct. 28, 2011, vol. 10, pp. 12224-1227.

(Continued)

*Primary Examiner* — Hoanganh Le

(57) ABSTRACT

A reconfigurable antenna that utilizes liquid metal to achieve dynamic antenna performance is disclosed. The reconfigurable antenna may utilize one or more liquid metal sections that can be variably displaced. Utilizing liquid metal may reduce certain undesirable effects associated with more conventional mechanical reconfigurable antennas including mechanical failure due to material fatigue, creep, and/or wear. Precise microfluidic techniques may be utilized in the design of a reconfigurable antenna that utilizes liquid metal. The reconfigurable antenna may utilize a circular Yagi-Uda array design and include movable parasitic director and reflector elements implemented using liquid metal (e.g., mercury (Hg)). The parasitic elements may be placed and rotated in a circular microfluidic channel around a driven antenna element utilizing a flow generated and controlled by a piezoelectric micropump. The reconfigurable antenna may operate at 1800 MHz with 4% bandwidth and be capable of performing beam steering over 360° with fine tuning.

23 Claims, 12 Drawing Sheets

(56) References Cited

U.S. PATENT DOCUMENTS

| | | | | |
|---|---|---|---|---|
| 8,354,972 | B2 | 1/2013 | Borja et al. | |
| 8,378,916 | B2 | 2/2013 | Quan et al. | |
| 2002/0003497 | A1* | 1/2002 | Gilbert et al. | 343/700 MS |
| 2002/0024468 | A1* | 2/2002 | Palmer et al. | 343/702 |
| 2002/0158798 | A1* | 10/2002 | Chiang et al. | 342/372 |
| 2004/0095288 | A1 | 5/2004 | Jackson | |
| 2004/0227583 | A1 | 11/2004 | Shaffner et al. | |
| 2004/0252069 | A1 | 12/2004 | Rawnick et al. | |
| 2005/0048934 | A1 | 3/2005 | Rawnick et al. | |
| 2005/0078047 | A1 | 4/2005 | Chiang et al. | |
| 2005/0088358 | A1 | 4/2005 | Larry et al. | |
| 2005/0190106 | A1 | 9/2005 | Anguera Pros et al. | |
| 2005/0212714 | A1* | 9/2005 | Chiang et al. | 343/810 |
| 2007/0046543 | A1 | 3/2007 | Choi et al. | |
| 2007/0200767 | A1 | 8/2007 | Yoshioka et al. | |
| 2007/0229357 | A1 | 10/2007 | Zhang et al. | |
| 2007/0279286 | A1 | 12/2007 | Coutts et al. | |
| 2008/0088510 | A1 | 4/2008 | Murata et al. | |
| 2008/0136597 | A1 | 6/2008 | Choi et al. | |
| 2009/0322646 | A1 | 12/2009 | Dreina et al. | |
| 2010/0095762 | A1 | 4/2010 | Despesse | |
| 2010/0117913 | A1 | 5/2010 | Jung | |
| 2010/0171675 | A1 | 7/2010 | Borja et al. | |
| 2010/0176999 | A1 | 7/2010 | Anguera et al. | |
| 2010/0238072 | A1 | 9/2010 | Ayatollahi et al. | |
| 2011/0095960 | A1 | 4/2011 | Shtrom et al. | |
| 2011/0109524 | A1 | 5/2011 | Säily | |
| 2011/0298684 | A1 | 12/2011 | Quan et al. | |
| 2012/0007778 | A1 | 1/2012 | Duwel et al. | |

OTHER PUBLICATIONS

Khoshniat et al., MEMS Integrated Reconfigurable Antenna for Cognitive Public Safety Radios, Proceedings of the Fourth European Conference on Antennas and Propagation (EuCAP), Barcelona, Spain, Apr. 12-16, 2010, pp. 1-3.

Jofre et al., Miniature Multi-element Antenna for Wireless Communications, IEEE Transactions on Antennas and Propagation, May 2002, vol. 50, Issue 5, pp. 658-669.

Notification of Transmittal of the International Search Report and the Written Opinion of the International Searching Authority, or the Declaration, dated Aug. 27, 2013, for PCT/US2012/064616, filed Nov. 12, 2012.

Notification of Transmittal of the International Search Report and the Written Opinion of the International Searching Authority, or the Declaration, dated Jul. 25, 2013, for PCT/US2012/059378, filed Oct. 9, 2012.

Rodrigo, Jofre, Cetiner, "Circular Beam-Steering Reconfigurable Antenna with Liquid Metal Parasitics", IEEE Transactions on Antennas and Propagation, vol. 60, No. 4, p. 1796-1802, Apr. 2012.

Ju-Hee et al., Reversibly Deformable and Mechanically Tunable Fluidic Antennas, Advanced Functional Materials, Nov. 23, 2009, pp. 3632-3637, vol. 19, Issue 22, Wiley-VCH Verlag GmbH & Co.

Notification of Transmittal of the International Search Report and the Written Opinion of the International Searching Authority, or the Declaration, dated Aug. 26, 2013, for PCT/US2012/068386, filed Dec. 7, 2012.

* cited by examiner

RECONFIGURABLE ANTENNAS UTILIZING LIQUID METAL ELEMENTS

CROSS-REFERENCE TO RELATED APPLICATIONS

This application claims the benefit under 35 U.S.C. §119 (e) of U.S. Provisional Application No. 61/568,041, filed Dec. 7, 2011, which is hereby incorporated by reference herein in its entirety.

STATEMENT REGARDING FEDERALLY SPONSORED RESEARCH

The technology described in this application was developed in part by Award No. 2007-IJCX-K025 and Award No. 2009-SQ-B9-K005, awarded by the National Institute of Justice, Office of Justice Programs, U.S. Department of Justice. The government has certain rights in the invention.

TECHNICAL FIELD

The present disclosure relates generally to reconfigurable antennas and, more specifically, to a reconfigurable antenna design utilizing liquid metal.

SUMMARY

A reconfigurable antenna is disclosed herein which includes a central active element on a first side of a dielectric substrate, a ground plane on a second, opposing side of the dielectric substrate, a microfluidic channel circularly disposed on the first side of the dielectric substrate around the central active element, and one or more liquid metal parasitic elements disposed within the microfluidic channel. The central active element may include a loop antenna, such as an Alford-type loop antenna, and/or one or more printed dipoles rotationally distributed over a loop. The central active element may also be configured to produce an omnidirectional radiation pattern and horizontal polarization. The liquid metal parasitic elements include mercury and may be configured to move within the microfluidic channel to produce a rotation of a radiation pattern of the reconfigurable antenna. The liquid metal parasitic elements may be separated from one another in the microfluidic channel by de-ionized water. In one embodiment, the reconfigurable antenna may also include a micropump which is serially coupled with the microfluidic channel and which is configured to actuate a position of one or more liquid metal parasitic elements within the microfluidic channel.

In one embodiment, the reconfigurable antenna includes a circular Yagi-Uda array which includes a central active element, a microfluidic channel circularly disposed around the central active element, a reflector element, a director element, and a micropump serially coupled with the microfluidic channel configured to actuate a position of the reflector element and the director element within the microfluidic channel. The reflector element and the director element may include liquid metal disposed within the microfluidic channel. The reconfigurable antenna may include a ground plane, having a balun, and which is separated from the central active element by a dielectric substrate. The reflector element and the director element may be separated from one another in the microfluidic channel by de-ionized water. The reconfigurable antenna may include one or electrodes to actuate the liquid metal parasitic elements within the microfluidic channel to produce a rotation of the radiation pattern antenna. The electrodes may actuate the liquid metal parasitic elements using electrowetting on dielectric (EWOD) techniques.

DETAILED DESCRIPTION

The proliferation of wireless devices has made the development of antennas capable of exhibiting variable radiation patterns desirable. A reconfigurable antenna that utilizes liquid metal to achieve dynamic antenna performance is disclosed. In certain embodiments, the reconfigurable antenna may utilize one or more liquid metal sections that can be variably displaced. Utilizing liquid metal may reduce certain undesirable effects associated with more conventional mechanical reconfigurable antennas including mechanical failure due to material fatigue, creep, and/or wear.

In some embodiments, precise microfluidic techniques including, for example, continuous-flow pumping or electrowetting may be utilized in the design of a reconfigurable antenna that utilizes liquid metal. In certain embodiments, electrowetting-on dielectric (EWOD) digital microfluidic techniques may be utilized to control liquid metal elements of the reconfigurable antenna. The reconfigurable antenna may utilize a circular Yagi-Uda array design and include movable parasitic director and reflector elements implemented using liquid metal (e.g., mercury (Hg)). The parasitic elements may be placed and rotated in a circular microfluidic channel around a driven antenna element utilizing a flow generated and controlled by a piezoelectric micropump. In certain embodiments, the reconfigurable antenna may operate at 1800 MHz with 4% bandwidth and be capable of performing beam steering over 360° with fine tuning.

Reconfigurable antennas capable of varying operating frequency, bandwidth, radiation pattern, and/or polarization offer certain advantages over non-reconfigurable antennas due to their capability of providing dynamic adaptation to changes in a communications channel or in system requirements. In embodiments disclosed herein, a reconfigurable antenna is presented that utilizes liquid metal elements and fluidic-specific actuators to achieve an antenna design that is resilient to wear. Particularly, the reconfigurable antenna utilizes liquid metal to implement movable parasitic elements configured to steer the antenna beam through one or more variable positions. In certain embodiments, the liquid metal elements may be actuated using microfluidic techniques common to chemical and medical applications. In alternative embodiments, the liquid metal elements may be actuated using electromagnetics.

Figure 1:
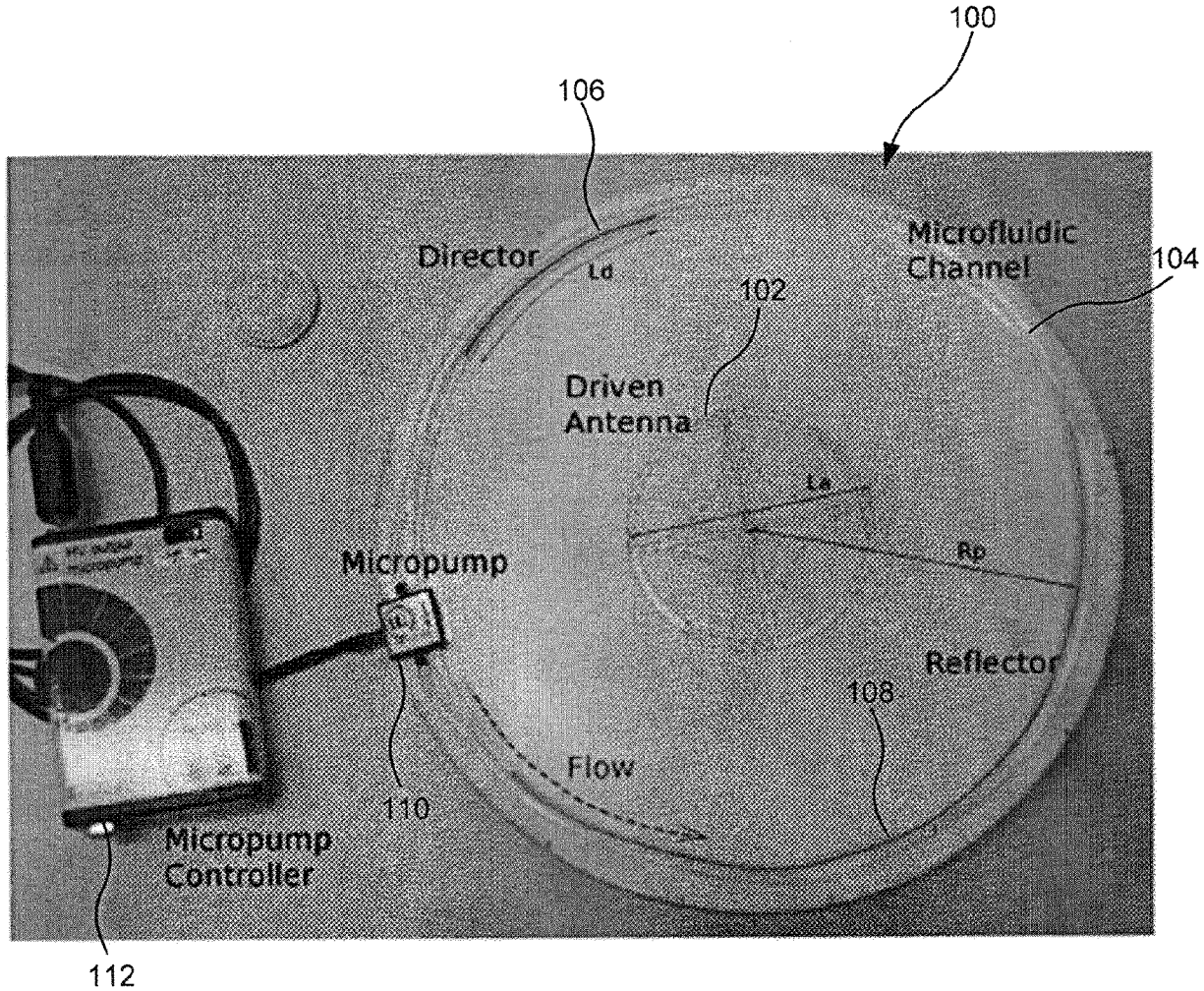
FIG. 1 illustrates an example of a reconfigurable antenna utilizing liquid metal elements.

FIG. 1 illustrates an example of a reconfigurable antenna utilizing liquid metal elements consistent with embodiments disclosed herein. The reconfigurable antenna 100 may be based on a reconfigurable Yagi-Uda type array comprising a central active driven element 102 and at least one movable liquid metal parasitic section located in a microfluidic channel 104 circularly arranged around the center active driven element 102. In one embodiment, the liquid metal parasitic section may include a director 106 and a reflector 108, as shown in the example of FIG. 1. In certain embodiments, the driven element 102, which may be constructed of solid copper or a similar material, may have a static behavior while reconfigurability of the antenna is achieved by varying the position (s) of the at least one liquid metal parasitic sections, for example director 106 and reflector 108. In some embodiments, the reconfigurable antenna may be configured to operate in an 1800 MHz Long Term Evolution ("LTE") band and/or in U.S. public safety communication bands.

In one embodiment, a micropump 110 can be utilized to change the position of the liquid metal parasitic elements 106 and 108 by controlling a continuous flow inside the microfluidic channel 104. The micropump may be controlled by an external controller 112. In some embodiments, the design of the driven antenna 102 and the liquid metal parasitic elements 106 and 108 may allow for continuous steering of the radiation pattern of the reconfigurable antenna 100 with fine tuning over a 360° range. The disclosed reconfigurable antenna 100 may be mechanically robust due in part to low power consumption, less inertial problems associated with moving elements, natural auto-lubrication, and improved liquid heat dissipation associated with the liquid metal movable parasitics.

Driven Antenna

In some embodiments, the reconfigurable antenna 100 may be reconfigured using one or more electromagnetically coupled liquid metal parasitic elements. A driven antenna, such as driven antenna 102 in the example of FIG. 1, may be designed to improve induced currents over the parasitic elements 106 and 108. In certain embodiments, the driven antenna 102 may comprise a central active element with an omnidirectional pattern and horizontal polarization. The radiation pattern of the central active element may be designed to exhibit a maximum in the plane of the parasitic elements and a substantially constant magnitude and phase of the generated electric field over the microfluidic channel. By designing the central active element to exhibit a substantially constant magnitude and phase over the microfluidic channel, the movement of the liquid metal parasitic elements 106 and 108 in the microfluidic channel 104 may produce a low-distortive rotation of the radiation pattern of the reconfigurable antenna 100.

In certain embodiments, a loop antenna exhibiting a horizontal polarization, an omnidirectional pattern, and a substantially constant electric field over the microfluidic channel ensured by the revolution symmetry of its currents may be utilized as the driven antenna 102 in the disclosed reconfigurable antenna. The loop antenna may be further designed to be electrically small to maintain a substantially uniform current. In some embodiments, the loop antenna may comprise an Alford-type loop that includes a set of in-phase fed antennas rotationally distributed over a circumference that produces a pattern that can be effectively modified using parasitic elements.

The Alford-type loop antenna utilized in certain embodiments of the disclosed reconfigurable antenna 100 may be designed to have certain parameters including substantially uniform radiation pattern, a particular horizontal diameter, and a particular thickness. Design considerations for each of these parameters utilized in embodiments of the reconfigurable antenna 100 are discussed below.

Pattern Uniformity: Increasing the number of sections of the Alford-type loop may result in an omnidirectional pattern with higher uniformity and less variable electric field over the circular microfluidic channel. In certain embodiments, the reconfigurable antenna 100 may utilize at least four sections to reduce radiation pattern distortions when the liquid metal parasitic elements are reconfigured.

Horizontal Dimensions: The dimensions of the driven antenna 102 may be related to the parasitic elements 106 and 108. As the parasitic elements are utilized to provide directionality to the reconfigurable Yagi-Uda array antenna, the lengths of the parasitic elements may be comparable relative to the central Alford-type loop length so that the radiation pattern is not dominated by the central driven antenna. For example, if a half wavelength director is utilized to represent at least 50% of the driven element length, the diameter of the central antenna may be $\lambda_0/3$.

Thickness: In various embodiments, low profile printed antenna designs may be utilized in the disclosed reconfigurable antenna 100 due to their integrability, low-weight, and manufacturing ease using surface micromachining techniques. At higher operating frequencies, manufacturing using surface micromachining techniques may allow for easier integration of antenna elements, microfluidic systems, and control circuitry.

Figure 2:
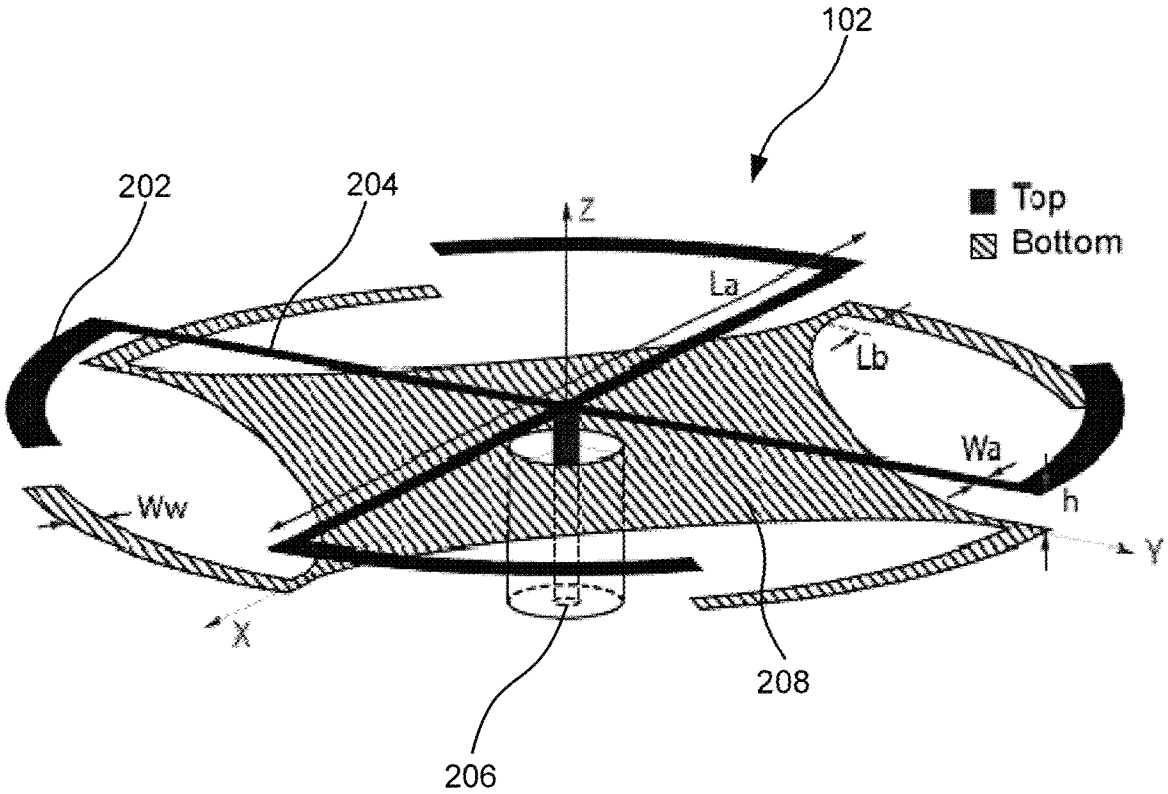
FIG. 2 illustrates an example of a three-dimensional schematic of the driven antenna design.

FIG. 2 illustrates an example of a three dimensional schematic of the driven antenna design consistent with embodiments disclosed herein. In certain embodiments, the driven antenna 102 may be fabricated in part using a dielectric substrate (e.g., RO4003C™ substrate material having a dielectric constant or static relative permittivity of approximately $\in_r$=3.55 and a height of 0.81 mm manufactured by Rogers Corporation™). As illustrated in the example of FIG. 2, the driven antenna 102 may comprise one or more printed dipoles 202 rotationally distributed over a loop. In certain embodiments, as illustrated in the example of FIG. 2, four printed dipoles may be used in view of size considerations and pattern uniformity. In some embodiments, the driven antenna 102 may have a diameter ($L_a$) of 58.5 mm ($0.35\lambda_0$) and a simulated pattern variation over the horizontal plane of ±0.09 dB.

The four dipoles 202 may be in-phase fed using transmission lines 204 that transport energy from a coaxial feed 206.

In certain embodiments, the lengths of the transmission lines 204 in terms of the effective wavelength of the antenna may be $0.27\lambda_{ef}$. The equivalent impedance of each dipole 202 can be adjusted by modifying the transmission line widths in order to obtain a 50Ω impedance after the parallel combination of the four dipoles at the coaxial feeding point.

In certain embodiments, the reconfigurable antenna 100 may be microstrip fed and utilize a balun to transform an unbalanced microstrip feed into a balanced line to feed each dipole 202. The balun design may comprise a progressive reduction of the microstrip ground plane 208. In some embodiments, the length of the balanced line may be approximately a quarter wavelength.

Figure 3:
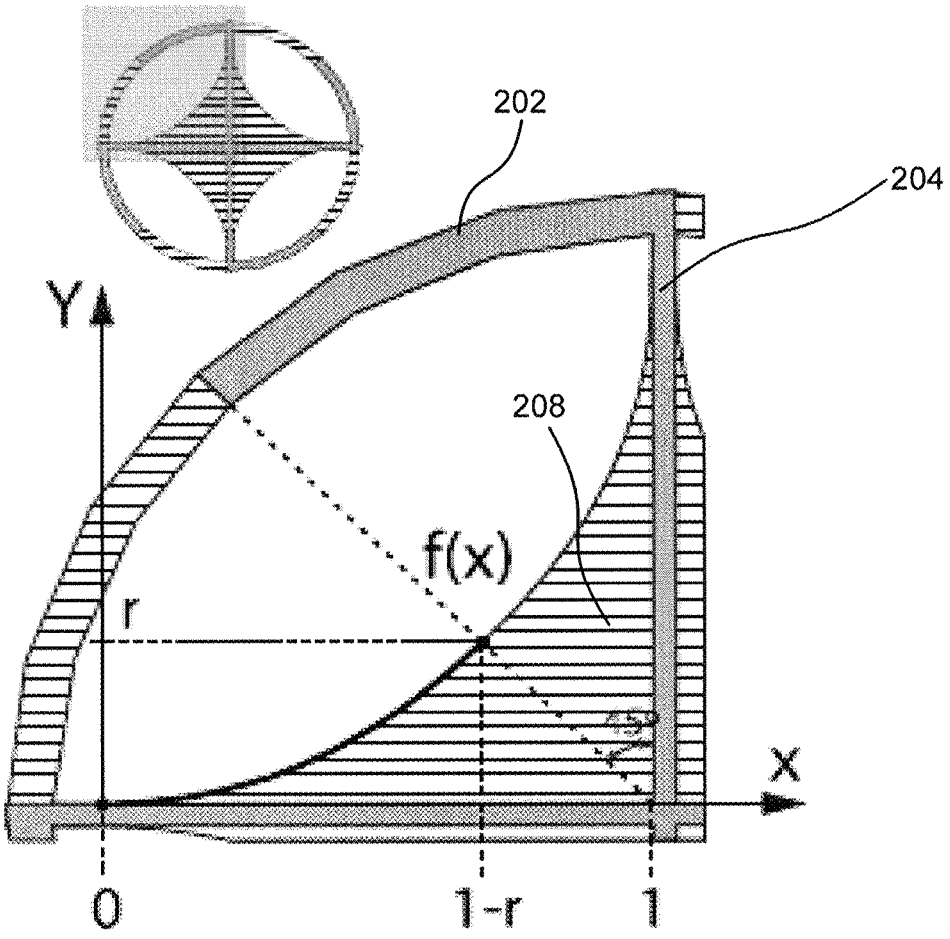
FIG. 3 illustrates an example analytical representation of a balun contour.

FIG. 3 illustrates an example analytical representation of a balun contour consistent with embodiments disclosed herein. The taper function of a normalized length balun may be represented by f(x), $0 \le x \le 1-r$. The complete balun may be obtained by applying repeated 90° rotations to the basic taper function and may be properly designed to ensure smoothness. First order continuity constraints for the balun design are presented below in Equation 1, where r is a shape factor parameter representing the narrowing rate of the microstrip ground plane 208 illustrated in FIG. 3.

$$f(0)=0\ f(1-r)=r$$

$$f'(0)=0\ f'(1-r)=1 \quad (1)$$

In certain embodiments, an exponential taper may be utilized in the balun design. In other embodiments, a potential-function taper may be utilized having a compact analytical solution presented below in Equation 2.

$$F(x)=Ax^B, \text{ where } A=r(1-r)^{1-1/r}$$

$$B=1/r-1$$

$$r<0.5 \quad (2)$$

Figure 4:
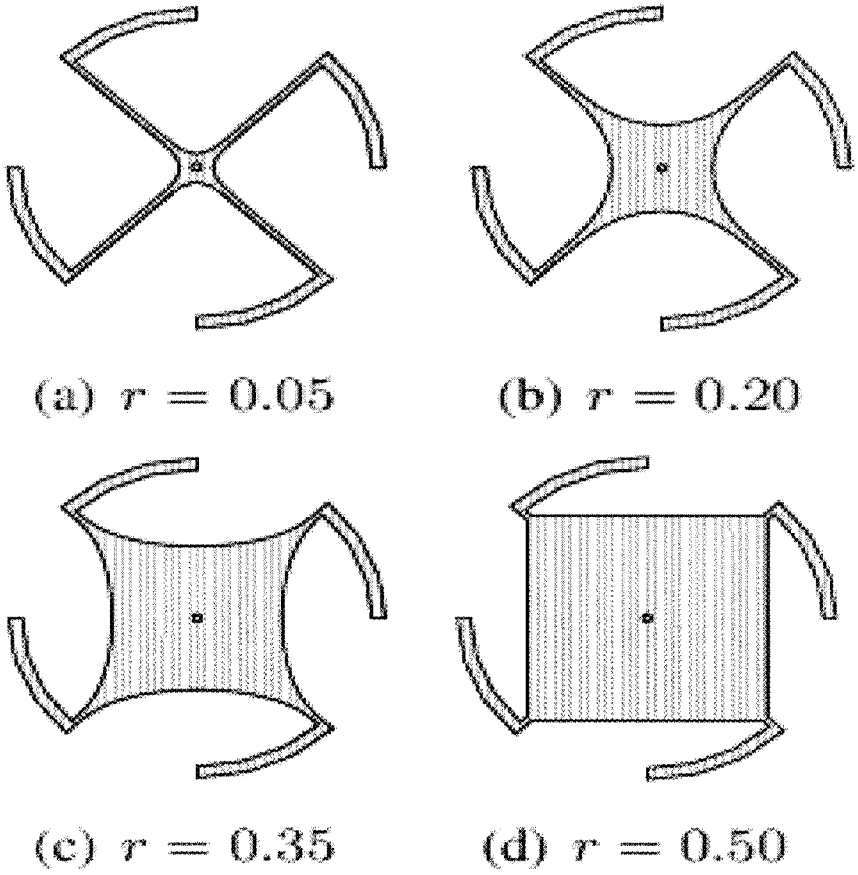
FIG. 4 illustrates an example bottom layer of the balun structure for different values of the shape factor r.
Figure 5:
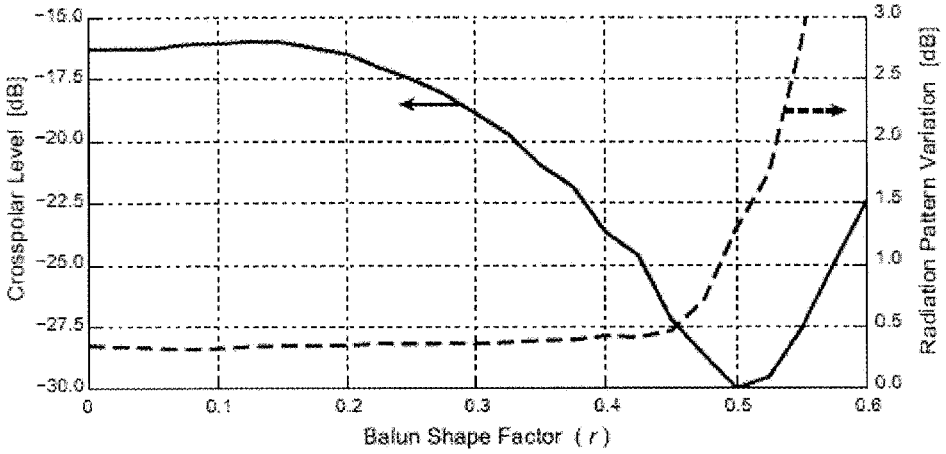
FIG. 5 illustrates example plots depicting performance of the balun for different shape factors obtained by analyzing crosspolar levels of a reconfigurable antenna.

FIG. 4 illustrates an example bottom layer of the balun structure for different values of the shape factor r consistent with embodiments disclosed herein. FIG. 5 illustrates example plots depicting performance of the balun for different shape factors obtained by analyzing crosspolar levels of a reconfigurable antenna consistent with embodiments disclosed herein. As illustrated, shape factor values between 0.4 and 0.5 may result in example crosspolar levels between −23 dB and −30 dB.

Figure 6:
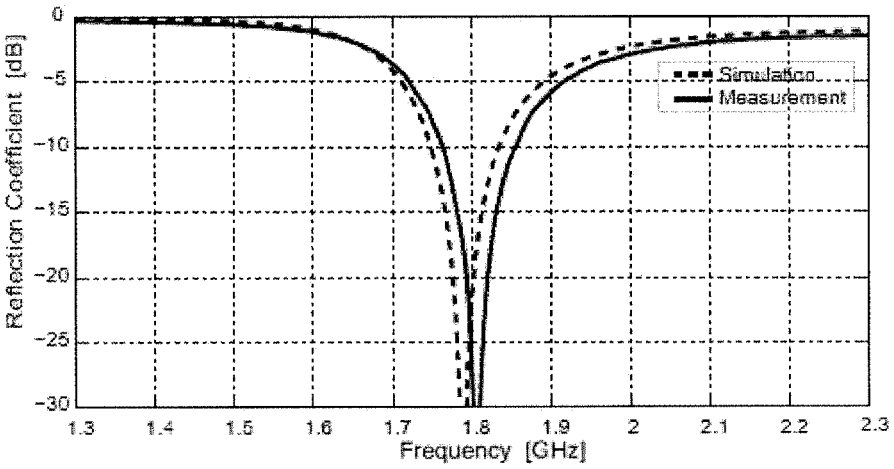
FIG. 6 illustrates example plots depicting simulated and measured reflection coefficients for an example reconfigurable antenna.

FIG. 6 illustrates example plots depicting simulated and measured reflection coefficients for an example reconfigurable antenna consistent with embodiments disclosed herein. As shown, the reconfigurable antenna may show good agreement between simulations and measurements for the resonance frequency (e.g., 1.8 GHz) and bandwidth (e.g., 5.0%) of the example antenna.

Figure 7:
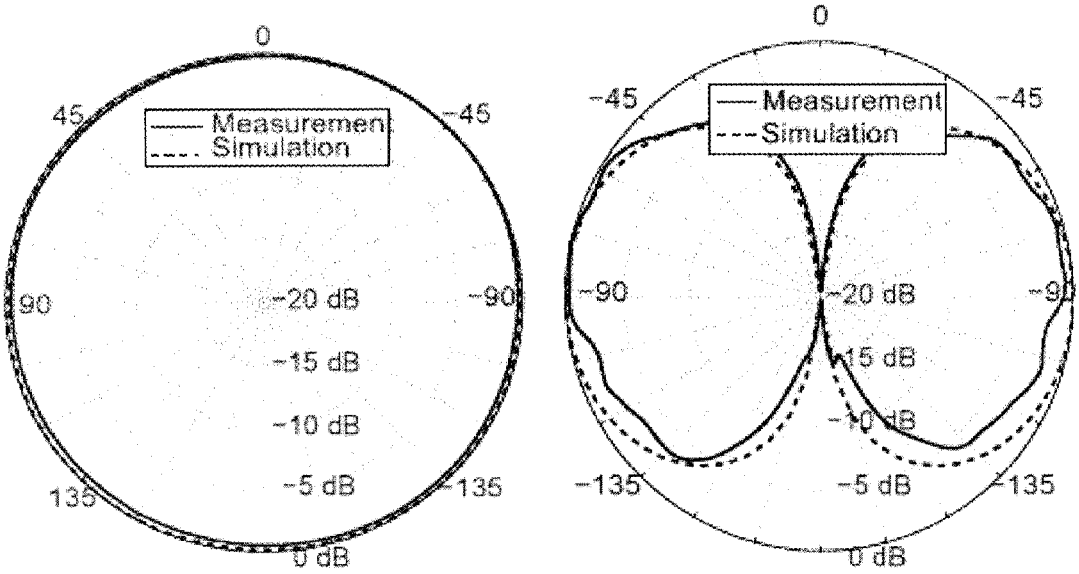
FIG. 7 illustrates example plots depicting radiation patterns across two planes for an example reconfigurable antenna.

FIG. 7 illustrates example plots depicting radiation patterns across two planes for an example reconfigurable antenna consistent with embodiments disclosed herein. As illustrated, the measured radiation pattern variation over the horizontal plane may be ±0.3 dB. In certain embodiments, this measured variation may be small enough to preserve the integrity of the radiation pattern during movement of the parasitic elements. The measured crosspolar level may be below −20 dB.

Parasitic Element Optimization

Utilizing the Yagi-Uda array principle, the disclosed reconfigurable antenna 100 may generate a directional radiation pattern using one or more parasitic elements. In designing the reconfigurable antenna 100, the location and dimensions of the parasitic elements may be optimized to increase directivity and front-to-back ratio for the reconfigurable antenna. In certain embodiments, such as the example of FIG. 1, an antenna geometry including one reflector 108 and one director 106 on a single microfluidic channel 104 may be utilized, although other geometries including multiple reflectors, directors, and/or microfluidic channels are also contemplated.

Figure 8:
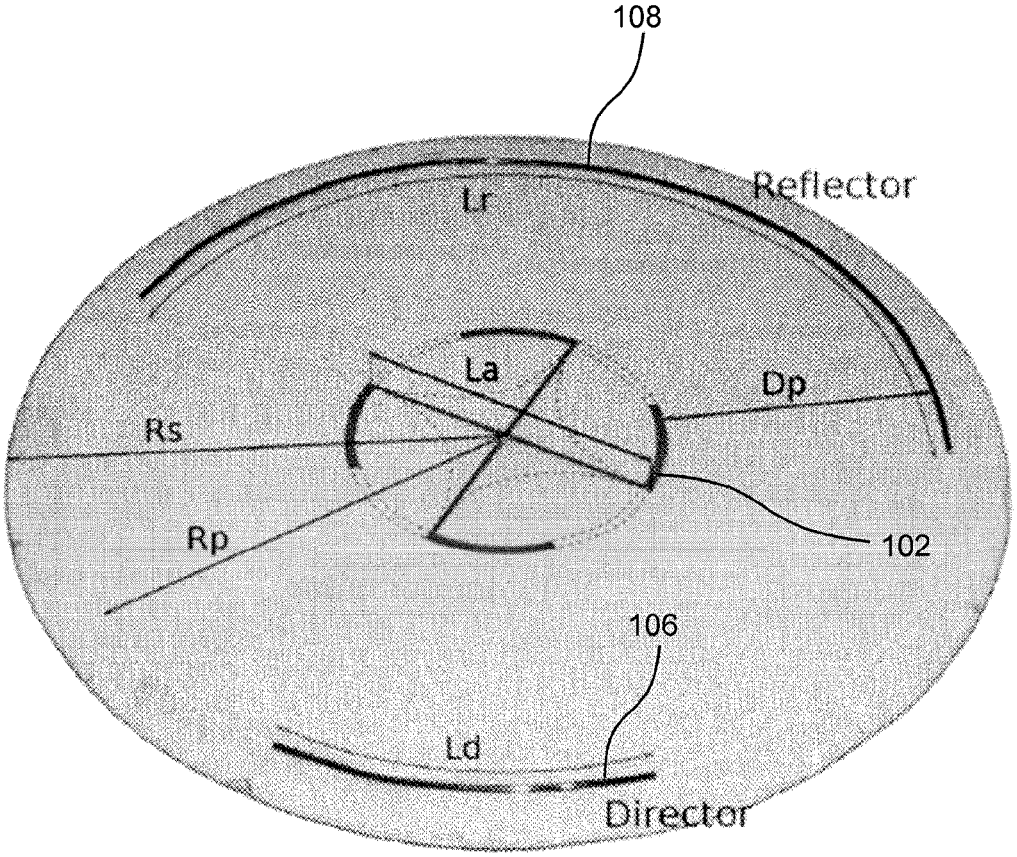
FIG. 8 illustrates design dimensions for an example reconfigurable antenna.

FIG. 8 illustrates design dimensions for an example reconfigurable antenna consistent with embodiments disclosed herein. In certain embodiments, the distance $D_p$ between the driven antenna 102 and the parasitic elements 106 and 108 may be between $0.15\lambda_0$ and $0.35\lambda_0$. The parasitic elements 106 and 108 may be distributed over a circle having a radius $R_p$=80 mm, corresponding to a distance $D_p$=50.75 mm=$0.3\lambda_0$. In some embodiments, the director 106 may be shorter than the resonant length, which may result in an optimum value of $L_d$=62 mm. The electrical length of the director 106 may be $0.45\lambda_{eff}$ based on the effective permittivity of the dipole over the substrate being $\in_{r,eff}$=1.41. In certain embodiments, reflector parasitics with a large length $L_r$ may produce a stronger reflection. Accordingly, the reflector 108 may be designed to operate at a second resonance having an electrical length longer than $3/2\lambda_{eff}$ (e.g., 217 mm corresponding to $1.56\lambda_{eff}$).

Figure 9:
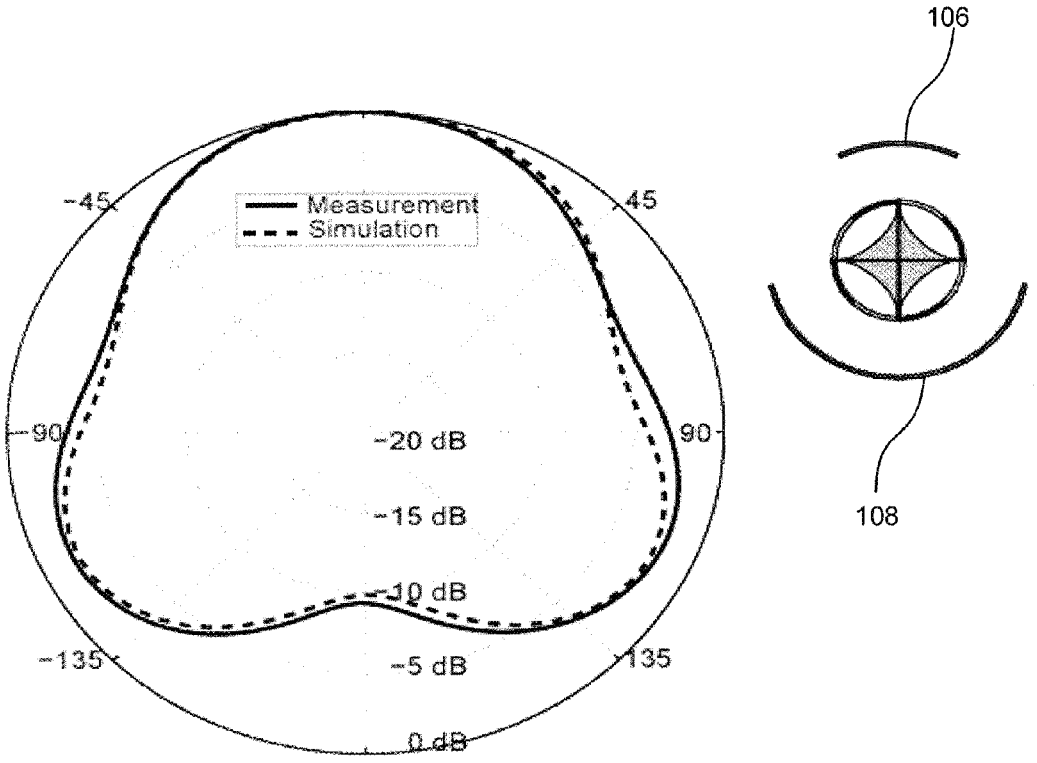
FIG. 9 illustrates example plots depicting simulated and measured radiation patterns for an example reconfigurable antenna that includes copper wire replacements for the liquid metal parasitic elements.

In certain embodiments, for characterization purposes, segments of liquid metal included in the reconfigurable antenna design may be replaced by sections of wire (e.g., solid copper wire). FIG. 9 illustrates example plots depicting simulated and measured radiation patterns for an example reconfigurable antenna that includes copper wire replacements for the liquid metal parasitic elements consistent with embodiments disclosed herein. As shown, the main beam of the example reconfigurable antenna points towards the director 106 with a beamwidth of approximately 90°. Two sidelobes are shown, with a power level of approximately −2 dB relative to the main beam. The level of the back radiation may be lower, having a front-to-back ratio of 10 dB, making the example antenna particularly suited for application where a low level of back radiation is a more important design consideration than side-radiation. In certain embodiments, higher directivity and narrower beamwidth may be achieved by increasing the number of parasitic directors located over several concentric circles.

Figure 10:
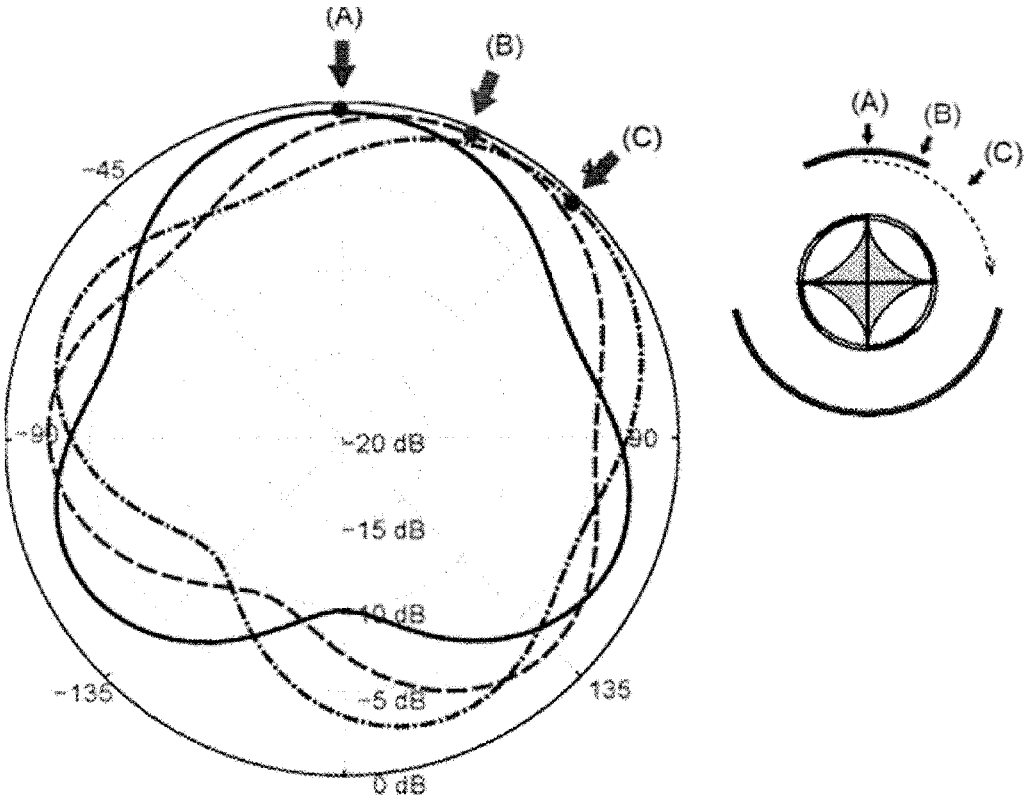
FIG. 10 illustrates example plots depicting measured radiation patterns of an example reconfigurable antenna with parasitic elements arranged at three different positions corresponding to rotation angles of 0°, 22.5°, and 45°.

In certain embodiments, the example antenna may allow for continuous steering of the radiation pattern by rotating the parasitics. FIG. 10 illustrates example plots depicting measured radiation patterns of an example reconfigurable antenna with parasitic elements arranged at three different positions corresponding to rotation angles of 0°, 22.5°, and 45°. As shown, the measured radiation pattern may be preserved with few distortions over the varied rotation angles.

Example Antenna Utilizing Liquid Metal Parasitic Elements

Replacing the solid wire parasitics, used in the example antenna discussed in reference to FIGS. 9 and 10, with liquid metal parasitics may allow for physical displacement of the parasitic elements using microfluidic techniques including pumping and electrowetting. Such an example reconfigurable antenna is illustrated in FIG. 1. In certain embodiments, the liquid metal parasitics may comprise liquid mercury due in part to its high conductivity, liquid form over a wide range of temperatures, and low adhesion to plastic elements thereby reducing wetting of the tubing. In further embodiments, a non-toxic liquid metal such as, for example, Galinstan® may be utilized. Alternatively or in addition, the liquid metal may comprise cesium, francium, bromine, and/or any other liquid metal and/or conductive liquid material having electromagnetic properties suitable for forming active and/or parasitic antenna elements and capable of being reconfigured using the techniques disclosed herein. Any suitable combination of the above materials and/or other materials may be also utilized.

The liquid metal parasitic elements 106 and 108 may be confined in a microfluidic channel 104 having a diameter of, for example, 0.8 mm. In certain embodiments, the microfluidic channel 104 may be arranged in a closed double loop shape. The liquid metal parasitic elements 106 and 108 may be moved using a micropump 110 that is serially inserted into a tubing loop of the microfluidic channel 104. The micropump may be controlled by a variable voltage source (e.g., a micropump controller) 112.

The tubing of the microfluidic channel 104 may be arranged in a double loop shape, although other configurations are contemplated. Sections of the microfluidic channel 104 between the liquid metal parasitic elements 106 and 108 may be filled with de-ionized water. In certain embodiments, the total volume of water in the channel 104 is small and, accordingly, any radiation pattern modifications and efficiency reduction due to the water may not be significant.

In certain embodiments, the micropump 110 may be a piezoelectric actuated micropump (e.g., an mp5 micropump manufactured by Bartels Mikrotechnik GmbH). In some embodiments, the physical dimensions of the micropump 110 may be 14 mm×14 mm, which may be smaller than a tenth of the wavelength at the operating frequency. The micropump 110 may be voltage controlled by a 100 Hz square signal generated by the micropump controller 112. In certain embodiments, the driving signal may be designed to have an optimal signal shape and frequency for DI water pumping with the implemented micropump 110.

By varying the driving signal voltage (e.g., from 100V to 250V), the flow rate and thus the movement speed of the liquid metal parasitics may be adjusted. In certain embodiments, the flow rate may change linearly with the voltage, and the micropump 110 may be capable of achieving a high flow rate of 5 ml/min, providing the liquid metal parasitics with a linear speed of 0.16 m/s and a beam-steering reconfiguration speed of 2 rad/s. Higher speeds may be achieved by reducing the diameter of the microfluidic channel 104.

Perturbations observed in the performance of the reconfigurable antenna 100 may be attributed to the plastic tubing. For example, a slight increase of the effective permittivity $\in_{r,eff}$ seen by the liquid metal parasitics (e.g., $\in_{r,eff}$=1.41-1.49) may produce certain perturbations. These perturbations can be compensated for by shortening the physical lengths of the liquid metal parasitic elements 106 and 108. In certain embodiments, the dimensions of the microfluidic liquid metal parasitics 106 and 108 may be $L'_d$=58 mm and $L'_r$=205 mm, respectively.

Figure 11:
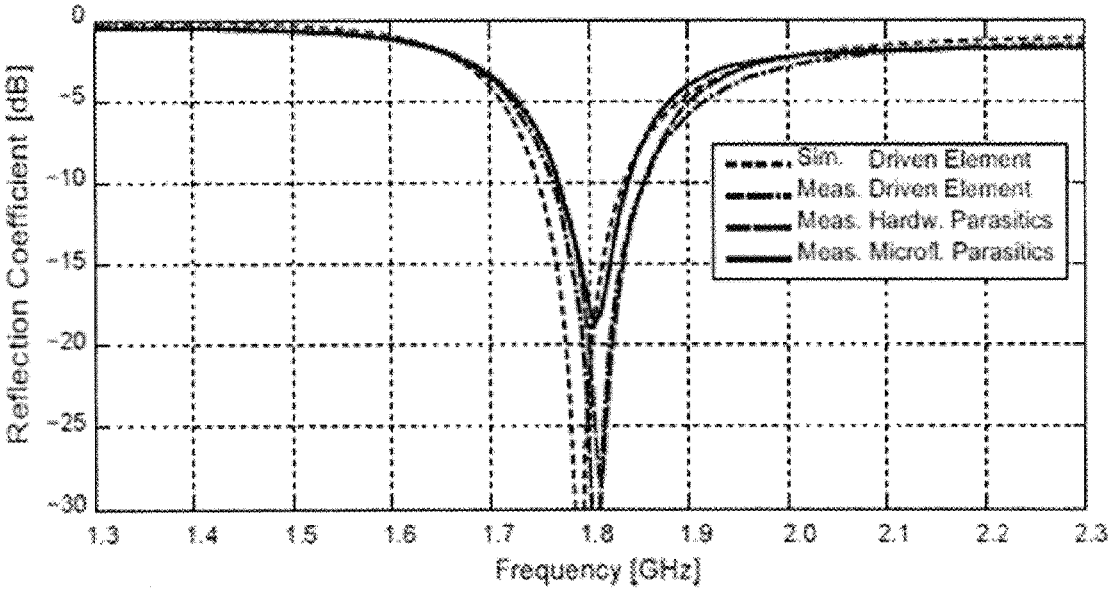
FIG. 11 illustrates example plots depicting measured reflection coefficients for an example reconfigurable antenna including liquid metal parasitics in comparison with an isolated driven element and an antenna including solid wire parasitics.

FIG. 11 illustrates example plots depicting measured reflection coefficients for an example reconfigurable antenna including liquid metal parasitics in comparison with an isolated driven element and an antenna including solid wire parasitics consistent with embodiments disclosed herein. As illustrated, the example reconfigurable antenna 100 including liquid metal parasitics has a resonance frequency of approximately 1.8 GHz. The frequency bandwidth of the example reconfigurable antenna is 4.0% at a −10 dB level.

Figure 12:
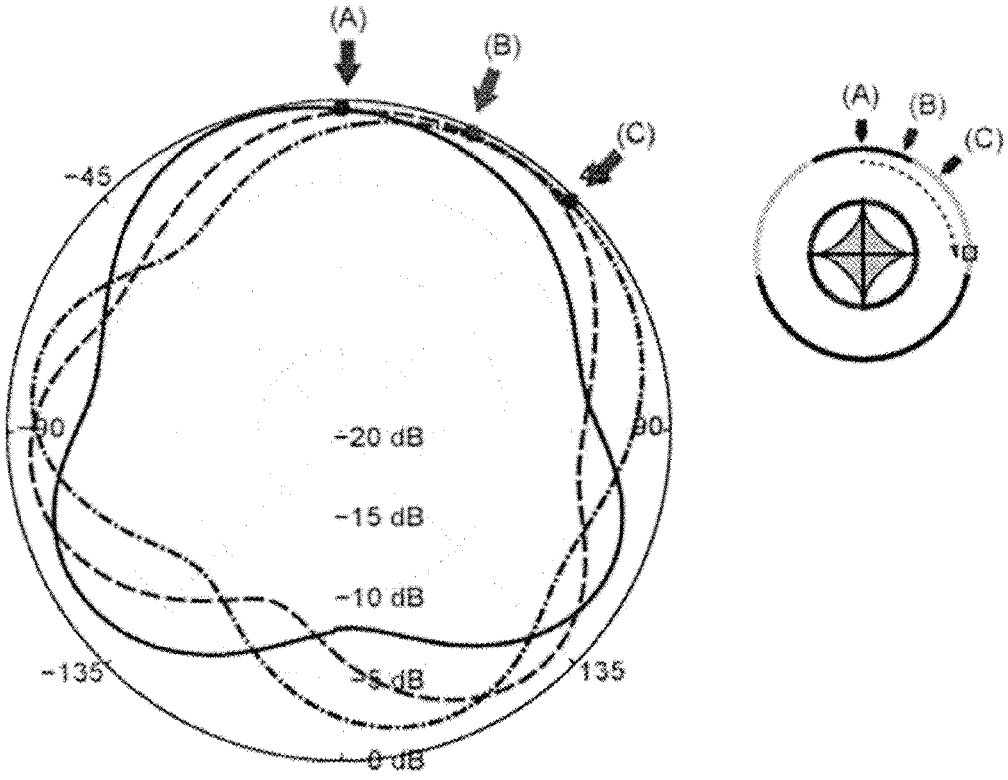
FIG. 12 illustrates example plots depicting measured radiation patterns of an example reconfigurable antenna with liquid metal parasitic elements arranged at three different positions corresponding to rotation angles of 0°, 22.5°, and 45°.
Figure 13:
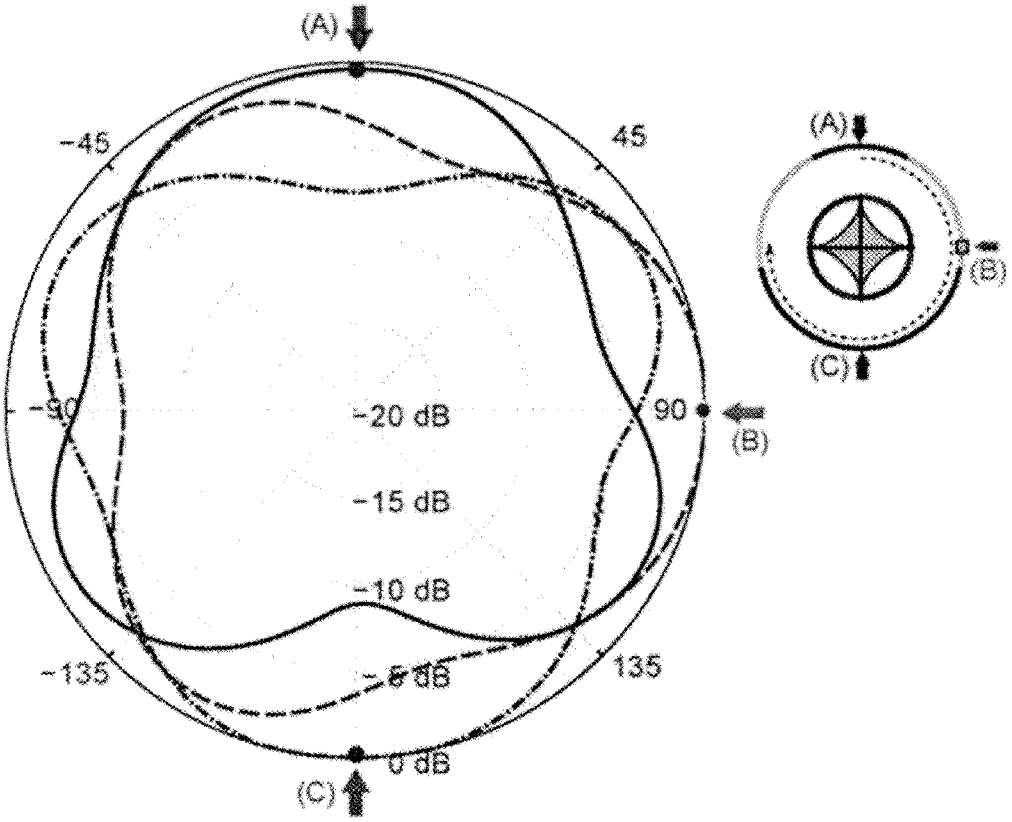
FIG. 13 illustrates example plots depicting measured radiation patterns of an example reconfigurable antenna with liquid metal parasitic elements arranged at three different positions corresponding to rotation angles of 0°, 90°, and 180°.

FIG. 12 illustrates example plots depicting measured radiation patterns of an example reconfigurable antenna with liquid metal parasitic elements arranged at three different positions corresponding to rotation angles of 0°, 22.5°, and 45°. Further, FIG. 13 illustrates example plots depicting measured radiation patterns of an example reconfigurable antenna with liquid metal parasitic elements arranged at three different positions corresponding to rotation angles of 0°, 90°, and 180°. As illustrated, the radiation pattern shape of the example reconfigurable antenna 100 is substantially preserved allowing reconfigurability in a range of 360°, with a minor decrease of 1 dB in both sidelobe ratio and front-to-back ration. The peak level variation between the illustrated configurations of the reconfigurable antenna is ±0.3 dB.

Other Microfluidic Techniques

Various embodiments of the reconfigurable antenna may utilize other microfluidic techniques for displacing the liquid metal parasitic elements. For example, digital microfluidics may be utilized. In certain embodiments, digital microfluidics may utilize metal electrodes to actuate liquid metal droplets of different sizes and shapes using electrowetting on dielectric (EWOD) techniques. In certain embodiments, utilizing such techniques may allow for precise control of the liquid metal parasitic elements position as well as the splitting and merging of liquid metal elements within the microfluidic channel.

It will be readily understood that the components of the disclosed embodiments, as generally described herein, could be arranged and designed in a wide variety of different configurations. For example, in certain embodiments, active driven antenna elements may also comprise liquid metal material and may be reconfigurable utilizing microfluidic techniques similar to those described above. Similarly, in further embodiments, antenna elements (e.g., active and/or parasitic elements) may comprise an array of microfluidic reservoirs that may be reconfigured to vary the architecture of the antenna. Embodiments disclosed herein may be also incorporated in other suitable antenna architectures and designs. Accordingly, the above detailed description of the embodiments of the systems and methods of the disclosure is not intended to limit the scope of the disclosure, but is merely representative of possible embodiments of the disclosure. In addition, the steps of any disclosed method do not necessarily need to be executed in any specific order, or even sequentially, nor do the steps need be executed only once, unless otherwise specified.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, inventive aspects lie in a combination of fewer than all features of any single foregoing disclosed embodiment. It will be apparent to those having skill in the art that changes may be made to the details of the above-described embodiments without departing from the underlying principles set forth herein.

What is claimed is:

1. A reconfigurable antenna comprising:

a central active element disposed on a first side of a dielectric substrate;

a ground plane disposed on a second side of the dielectric substrate, wherein the second side is opposite the first side;

a microfluidic channel circularly disposed on the first side of the dielectric substrate around the central active element; and one or more liquid metal parasitic elements disposed within the microfluidic channel.

2. The reconfigurable antenna of claim 1, wherein the central active element comprises a loop antenna.

3. The reconfigurable antenna of claim 2, wherein the central active element comprises an Alford-type loop antenna.

4. The reconfigurable antenna of claim 1, wherein the central active element comprises one or more printed dipoles rotationally distributed over a loop.

5. The reconfigurable antenna of claim 1, wherein the central active element is configured to produce an omnidirectional radiation pattern and horizontal polarization.

6. The reconfigurable antenna of claim 1, wherein the one or more liquid metal parasitic elements are configured to move within the microfluidic channel to produce a rotation of a radiation pattern of the reconfigurable antenna.

7. The reconfigurable antenna of claim 1, wherein the one or more liquid metal parasitic elements comprise mercury.

8. The reconfigurable antenna of claim 1 further comprising:

a micropump serially coupled with the microfluidic channel configured to actuate a position of the one or more liquid metal parasitic elements within the microfluidic channel.

9. The reconfigurable antenna of claim 1, wherein the one or more liquid metal parasitic elements are separated in the microfluidic channel by de-ionized water.

10. A reconfigurable antenna comprising:

a circular Yagi-Uda array including:

a central active element;

a microfluidic channel circularly disposed around the central active element;

a reflector element; and a director element;

wherein the reflector element and the director element comprise liquid metal disposed within the microfluidic channel; and a micropump serially coupled with the microfluidic channel configured to actuate a position of the reflector element and the director element within the microfluidic channel.

11. The reconfigurable antenna of claim 10, wherein the central active element comprises a loop antenna.

12. The reconfigurable antenna of claim 11, wherein the central active element comprises an Alford-type loop antenna.

13. The reconfigurable antenna of claim 10, further comprising:

a ground plane separated from the central active element by a dielectric substrate, wherein the ground plane comprises a balun.

14. The reconfigurable antenna of claim 10, wherein the central active element is configured to produce an omnidirectional radiation pattern and horizontal polarization.

15. The reconfigurable antenna of claim 10, wherein the reflector element and the director element are configured to move within the microfluidic channel to produce a rotation of a radiation pattern of the reconfigurable antenna.

16. The reconfigurable antenna of claim 10, wherein the reflector element and the director element are separated in the microfluidic channel by de-ionized water.

17. A reconfigurable antenna comprising:

a central active element;

a ground plane;

a microfluidic channel circularly disposed around the central active element;

one or more liquid metal parasitic elements disposed within the microfluidic channel; and one or more electrodes configured to actuate the one or more liquid metal parasitic elements within the microfluidic channel to produce a rotation of a radiation pattern of the reconfigurable antenna.

18. The reconfigurable antenna of claim 17, wherein the central active element comprises a loop antenna.

19. The reconfigurable antenna of claim 18, wherein the central active element comprises an Alford-type loop antenna.

20. The reconfigurable antenna of claim 17, wherein the central active element comprises one or more printed dipoles rotationally distributed over a loop.

21. The reconfigurable antenna of claim 17, wherein the one or more liquid metal parasitic elements comprise mercury.

22. The reconfigurable antenna of claim 17, wherein the one or more liquid metal parasitic elements are separated in the microfluidic channel by de-ionized water.

23. The reconfigurable antenna of claim 17, wherein the one or more electrodes are configured to actuate the one or more liquid metal parasitic elements within the microfluidic channel using electrowetting on dielectric (EWOD) techniques.

* * * * *